US009167335B2

(12) United States Patent
Ito et al.

(10) Patent No.: US 9,167,335 B2
(45) **Date of Patent: *Oct. 20, 2015**

(54) HEADPHONE

(71) Applicant: Sony Corporation, Tokyo (JP)

(72) Inventors: Tomohiro Ito, Tokyo (JP); Hiroaki Ishiguro, Tokyo (JP); Yuusuke Oosato, Tokyo (JP)

(73) Assignee: Sony Corporation, Tokyo (JP)

( * ) Notice: Subject to any disclaimer, the term of this patent is extended or adjusted under 35 U.S.C. 154(b) by 26 days.

This patent is subject to a terminal disclaimer.

(21) Appl. No.: 14/031,703

(22) Filed: Sep. 19, 2013

(65) Prior Publication Data

US 2014/0023222 A1 Jan. 23, 2014

Related U.S. Application Data

(63) Continuation of application No. 12/543,687, filed on Aug. 19, 2009, now Pat. No. 8,565,468.

(30) Foreign Application Priority Data

Aug. 20, 2008 (JP) ..... 2008-212151

(51) Int. Cl.
*H04R 1/10* (2006.01)
*H04R 5/033* (2006.01)

(52) U.S. Cl.
CPC ..... *H04R 1/105* (2013.01); *H04R 5/0335* (2013.01); *H04R 1/1058* (2013.01)

(58) Field of Classification Search
CPC ..... H04R 5/0335; H04R 1/10
USPC ..... 381/370, 371, 374, 376, 378, 379
See application file for complete search history.

(56) References Cited

U.S. PATENT DOCUMENTS

| | | | | | |
|---|---|---|---|---|---|
| 3,272,926 | A | * | 9/1966 | Falkenberg | 381/372 |
| 3,748,657 | A | | 7/1973 | Aileo | |
| 4,546,215 | A | | 10/1985 | Ferraro | |
| 4,571,746 | A | | 2/1986 | Gorike | |
| 4,634,816 | A | * | 1/1987 | O'Malley et al. | 379/430 |
| 4,727,585 | A | * | 2/1988 | Flygstad | 381/379 |
| 5,033,094 | A | * | 7/1991 | Hung | 381/379 |
| 5,068,923 | A | * | 12/1991 | Sjoqvist | 2/209 |

(Continued)

FOREIGN PATENT DOCUMENTS

| | | | |
|---|---|---|---|
| JP | 48-023736 | U | 7/1973 |
| JP | 56-167688 | U | 12/1981 |
| JP | 56-172082 | U | 12/1981 |
| JP | 58-082089 | U | 6/1983 |
| JP | 60-108093 | U | 7/1985 |
| JP | 60-178798 | A | 9/1985 |
| JP | 61-042186 | U | 3/1986 |
| JP | 06-054391 | A | 2/1994 |
| JP | 2001-197581 | | 7/2001 |
| JP | 3610618 | | 10/2004 |
| JP | 2007-336432 | | 12/2007 |

*Primary Examiner* — Duc Nguyen
*Assistant Examiner* — Phan Le
(74) *Attorney, Agent, or Firm* — Wolf, Greenfield & Sacks, P.C.

(57) ABSTRACT

There is provided a headphone including a headband having flexibility; a slider having flexibility with the headband attached at one end, and a headphone unit attached at the other end; a slide groove, arranged at an end of the headband or the one end of the slider, for guiding a circling movement of the slider with respect to the headband; and a slider guide, having rigidity higher than the headband and the slider, for holding the one end of the slider at the end of the headband so that one surface of the slider facing one surface of the headband circling moves with respect to the one surface of the headband while being engaged to the slide groove. A headphone that can be thinned while suppressing lowering of the attachment property is provided.

16 Claims, 10 Drawing Sheets

(56) References Cited

U.S. PATENT DOCUMENTS

| | | | | |
|---|---|---|---|---|
| 5,185,807 | A * | 2/1993 | Bergin et al. | 381/378 |
| 5,357,585 | A | 10/1994 | Kumar | |
| 5,708,725 | A | 1/1998 | Ito | |
| 5,793,878 | A | 8/1998 | Chang | |
| 6,219,851 | B1 | 4/2001 | Fang | |
| 6,678,897 | B2 | 1/2004 | Lindgren | |
| 6,754,361 | B1 * | 6/2004 | Hall et al. | 381/370 |
| 7,124,425 | B1 | 10/2006 | Anderson et al. | |
| 2001/0017925 | A1 | 8/2001 | Ceravolo | |
| 2003/0007660 | A1 * | 1/2003 | Tsunoda et al. | 381/370 |
| 2003/0210801 | A1 | 11/2003 | Naksen et al. | |
| 2008/0219470 | A1 | 9/2008 | Kimijima | |
| 2010/0046782 | A1 | 2/2010 | Ito et al. | |

* cited by examiner

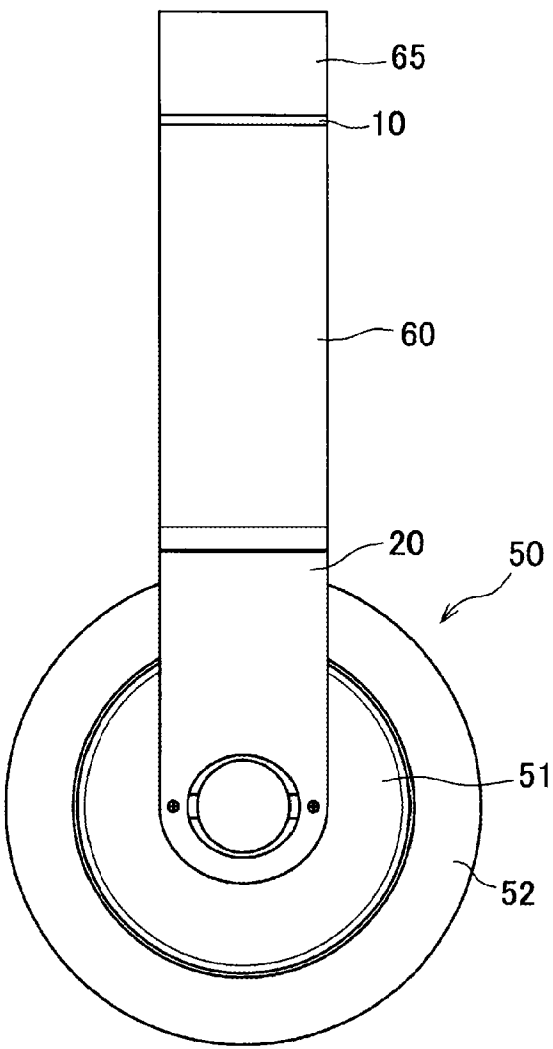
FIG.2
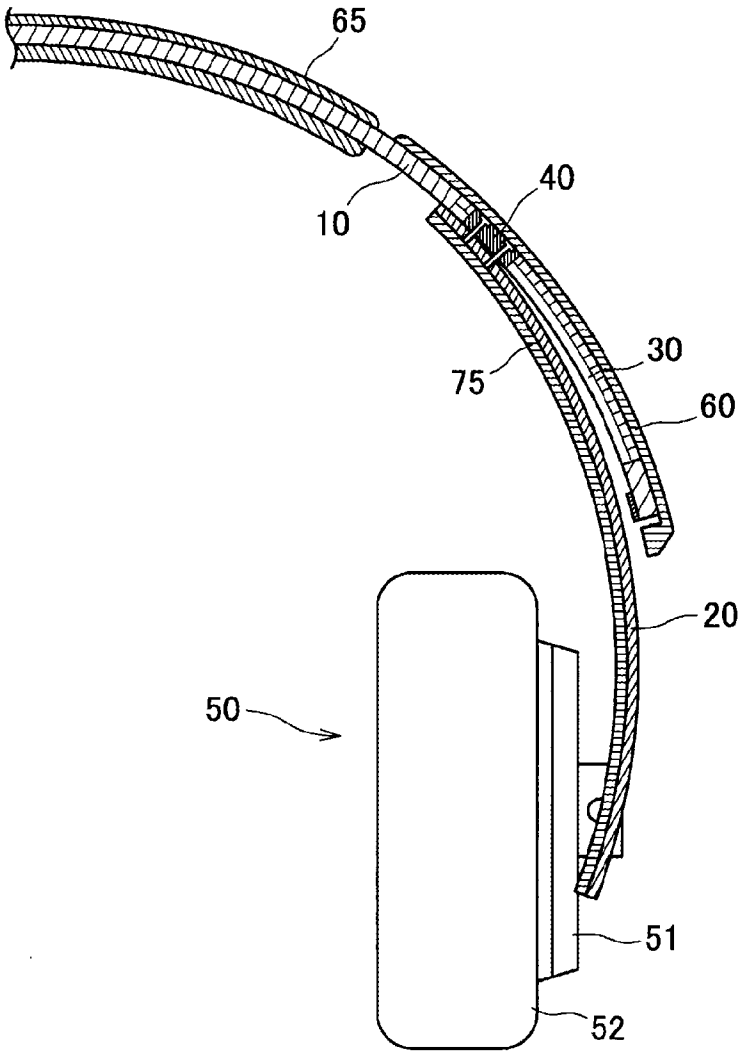

HEADPHONE

This application claims the benefit under 35 U.S.C. §120 of U.S. application Ser. No. 12/543,687, entitled "HEADPHONE" filed on Aug. 19, 2009, which is herein incorporated by reference in its entirety. Foreign priority benefits are claimed under 35 U.S.C. §119(a)-(d) or 35 U.S.C. §365(b) of Japanese application number 2008-212151, filed Aug. 20, 2008.

BACKGROUND OF THE INVENTION

1. Field of the Invention

The present invention relates to a headphone.

2. Description of the Related Art

A headphone including an adjust mechanism that can be adapted to the size of the head of a wearer has been known in the related art. FIGS. 8 and 9 are views showing a headphone of the related art including the adjust mechanism. The headphone shown in FIGS. 8 and 9 is configured to include a headband 1 and a slider 2, both of which have flexibility, where the slider 2 attached with a headphone unit 5 is attached to both ends of the headband 1. In an inserting type headphone (see Japanese Patent Publication No. 3610618) shown in FIG. 8, the band-shaped slider 2 is attached to the hollow headband 1 in an inserted state, and in a pass-through type headphone shown in FIG. 9, the two rail-shaped slider 2 is attached to a pass-through section protruding out to an outer peripheral side of the headband 1 in a passed-through state.

Since the size of the headphone is adjustable by means of the adjust mechanism, the wearer can use the headphone in a state adapted to the size of his/her head. Furthermore, the wearer can use the headphone in a state bent so as to follow the size of his/her head since the headband 1 and the slider 2 have flexibility.

SUMMARY OF THE INVENTION

However, in the headphone of the related art, since the headband 1 and the slider 2 are attached to each other in the inserted or the passed-through state, difference in cross-sectional shapes inevitably is created between the headband 1 and the slider 2, for example, the slider 2 becomes thin or narrow with respect to the headband 1.

When a large difference in rigidity is created due to the difference in cross-sectional shapes, the deflection of the slider 2 becomes large compared to the headband 1, for example, the slider 2 at both ends deflects to a "chevron" shape with respect to the headband 1, and the headphone may not be used in a state uniformly deflected so as to follow the size of the head of the wearer. The attachment property of the headphone thereby lowers.

In the headphone of the related art, the headband 1 and the slider 2 are attached to each other in the inserted or the passed-through state, and thus the member thickness h of the headband 1 inevitably becomes large, for example, to ensure the inner hollow cross-section. With respect to the headband 1 and the slider 2 having flexibility, the member thickness h of a connecting portion also becomes large in particular to ensure a predetermined rigidity at the connecting portion of the headband 1 and the slider 2. The thinning of the headphone thus becomes difficult.

It is desirable to provide a headphone that can be thinned while suppressing lowering of the attachment property.

According to an embodiment of the present invention, there is provided a headphone including: a headband having flexibility; a slider having flexibility with the headband attached at one end, and a headphone unit attached at the other end; a slide groove, arranged at an end of the headband or the one end of the slider, for guiding a circling movement of the slider with respect to the headband; and a slider guide, having rigidity higher than the headband and the slider, for holding the one end of the slider at the end of the headband so that one surface of the slider facing one surface of the headband circling moves with respect to the one surface of the headband while being engaged to the slide groove.

According to such configuration, the headband and the slider have flexibility, and one end of the slider is held at the end of the headband such that one surface of the slider facing one surface of the headband can circling move with respect to the one surface of the headband by a slider guide, having rigidity higher than the headband and the slider and being engaged to a slide groove. The headband and the slider are thus attached in a state not inserted or not passed-through with respect to each other.

Since one end of the slider is held at the end of the headband such that one surface of the slider facing one surface of the headband can circling move with respect to the one surface of the headband by the slider guide engaged to the slide groove, difference in cross-sectional shapes and rigidities is less likely to be created between the headband and the slider. The headphone then can be used in a state bent to follow the size of the head of the wearer, and lowering of the attachment property of the headphone can be suppressed.

Furthermore, since one end of the slider is held at the end of the headband by the slider guide having rigidity higher than the headband and the slider by way of the one surface of the headband and the one surface of the slider, the inner hollow cross-section may not be ensured, rigidity particularly at the connecting portion can be easily ensured by the slider guide, and the member thickness of the headband can be suppressed. The headphone thus can be easily thinned.

According to the embodiment of the present invention, a headphone that can be thinned while suppressing lowering of the attachment property is provided.

BRIEF DESCRIPTION OF THE DRAWINGS

FIG. 2 is a longitudinal cross-sectional view and a side view showing an adjust mechanism of the headphone;

DETAILED DESCRIPTION OF THE PREFERRED EMBODIMENTS

Figure 1:
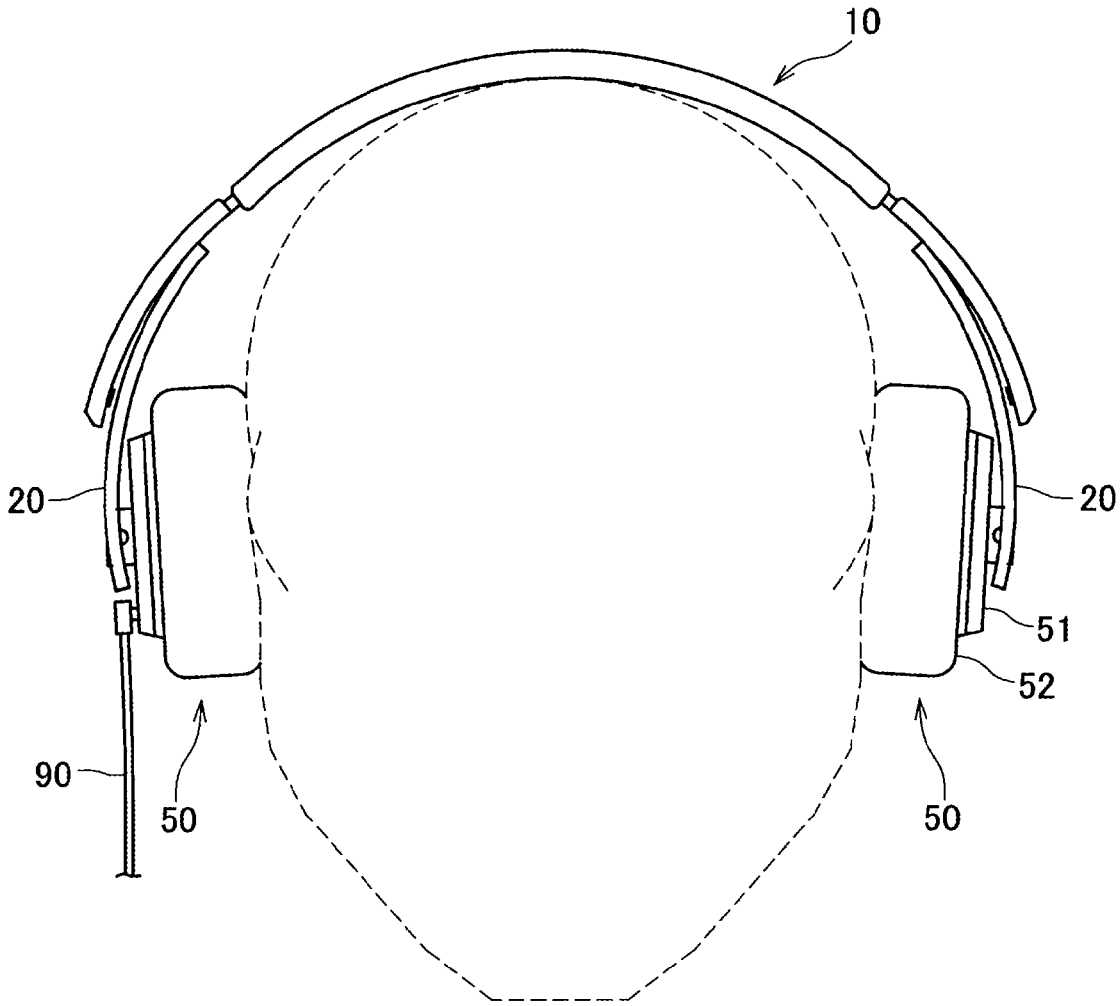
FIG. 1 is a front view showing an attachment state of a headphone according to the present embodiment.

Hereinafter, preferred embodiments of the present invention will be described in detail with reference to the appended drawings. Note that, in the specification and the appended drawings, structural elements that have substantially the same function and structure are denoted with the same reference numerals, and repeated explanation of these structural elements is omitted.

[Configuration of Headphone]

The configuration of a headphone according to one embodiment of the present invention will be described with reference to FIGS. 1 and 2. FIG. 1 is a front view showing an attachment state of the headphone according to the present embodiment. FIG. 2 is a longitudinal cross-sectional view and a side view showing an adjust mechanism of the headphone.

As shown in FIG. 1, the headphone is configured to include a headband 10, a slider 20 attached to both ends of the headband 10, and a headphone unit 50 attached to one end of the slider 20, where the headband 10 and the slider 20 are connected by way of an adjust mechanism, to be hereinafter described.

The headband 10 is formed to a substantially U-shape or a substantially C-shape having a predetermined curvature so as to be arranged along the top of the head of the wearer. The slider 20 is formed to a circular arc shape or an elliptical arc shape having a predetermined curvature so as to be arranged along the temporal region of the head of the wearer. The headband 10 and the slider 20 are formed as band-shaped bodies made of synthetic resin material, metal material, and the like so as to have a predetermined flexibility, where the headband 10 and the slider 20 (as a slider assembly including a slider cover 75 to be hereinafter described) have substantially the same cross-sectional shape.

At the headband 10 and the slider 20, a biasing force acts in a direction of reducing the curvature radius within a predetermined range, and the curvature changes within the predetermined range against the biasing force when a lateral pressure acts in a direction of increasing the curvature radius.

The headphone unit 50 includes a housing 51 incorporating a headphone driver (not shown), where an ear pad 52 made of sponge material and formed to cover the auricle of the wearer is arranged on a noise insulation surface side of the housing 51. The headphone unit 50 may be formed to be arranged on the auricle instead of being formed to cover the auricle of the wearer. A headphone cord 90 is connected to the headphone unit 50 to be attached to the auricle on the right side of the wearer.

The adjust mechanism is a mechanism for adjusting the size of the headphone so as to adapt to the size of the head of the wearer. The adjust mechanism is arranged at both ends of the headband 10 in the headphone according to the present embodiment, but the adjust mechanism arranged at the left end of the headband 10 will be described below since the adjust mechanism at both ends has a common structure.

As shown in FIG. 2, at the adjust mechanism, a slide groove 30 for regulating the circling movement range of the slider 20 so as to have a predetermined length along the longitudinal direction is arranged at the end of the headband 10, and a slider guide 40 for holding the slider 20 with respect to the head band 10 so as to be able to circling move is arranged at the end of the slider 20 (end on the side not attached with the headphone unit 50). The slider guide 40 is shorter than the slide groove 30 and has substantially the same width as the slide groove 30, and is made of synthetic resin material, metal material, and the like so as to have rigidity higher than the headband 10 and the slider 20.

The slider guide 40 holds one end of the slider 20 at the end of the headband 10 such that one surface of the slider 20 facing one surface of the headband 10 can circling move with respect to the one surface of the headband 10. In the headphone according to the present embodiment, the slider 20 is held so that the outer peripheral surface thereof can circling move with respect to the inner peripheral surface of the headband 10. The slider guide 40 holds the slider 20 at the end of the headband 10 while being engaged to the slide groove 30. The slider guide 40 moves along the slider groove 30 while engaged to the slide groove 30, whereby the slider 20 circling moves with respect to the headband 10 while being held at the end of the headband 10 by the slider guide 40.

[Detailed Structure of Headphone]

Figure 3:
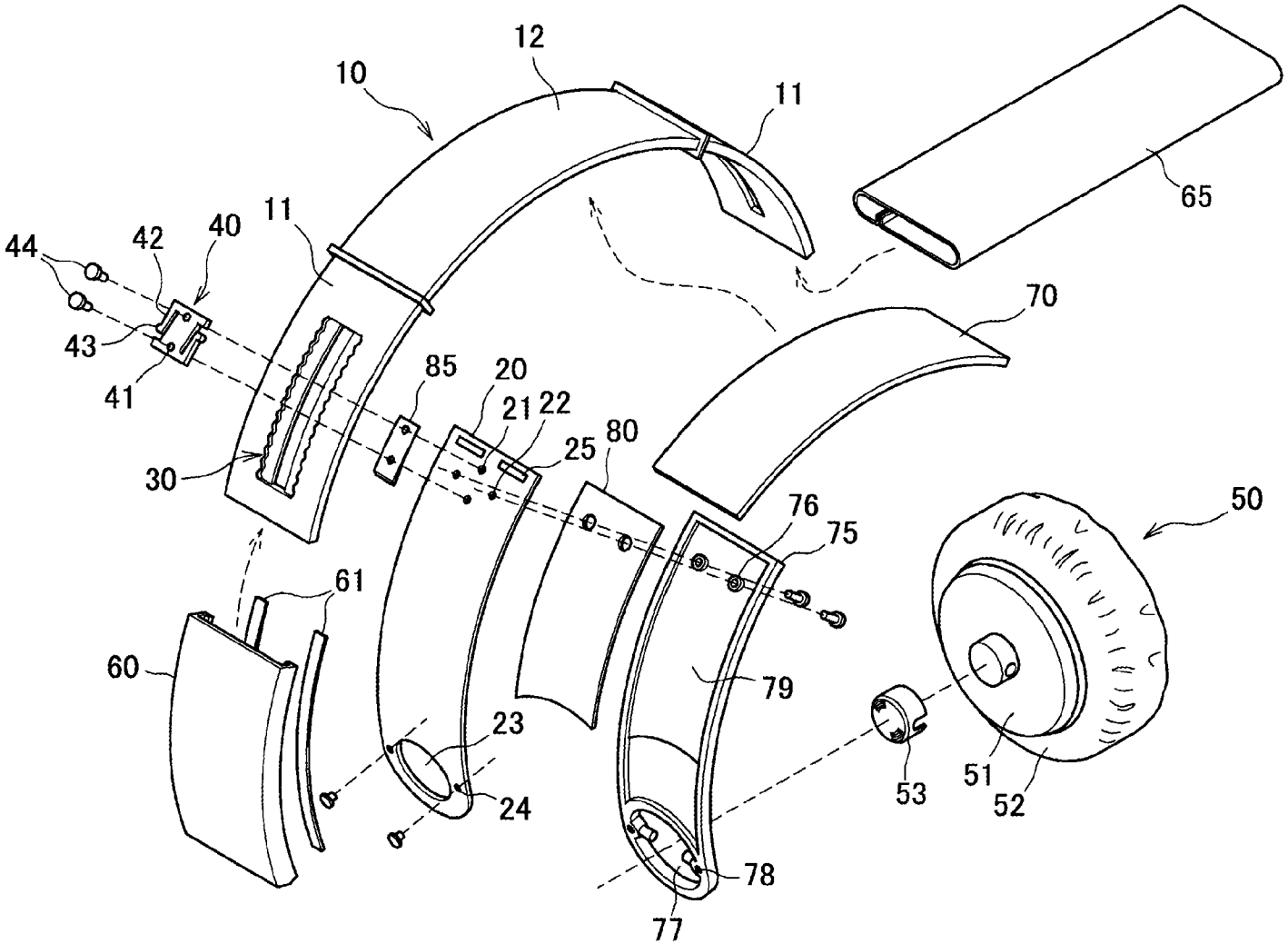
FIG. 3 is an exploded perspective view showing the detailed structure of the headphone.

The detailed structure of the headphone according to the present embodiment will be described below with reference to FIGS. 3 and 4. FIG. 3 is an exploded perspective view showing the detailed structure of the headphone, and FIG. 4 is a lateral cross-sectional view showing the adjust mechanism of the headphone.

As shown in FIG. 3, the headphone is configured to include a headband cover 60, a cushion cover 65, a cushion 70, a slider cover 75, a slider sheet 80, and a spacer 85, in addition to the headband 10, the slider 20, the slider guide 40, and the headphone unit 50.

The headband 10 is formed as a substantially U-shaped band-shaped body having a predetermined curvature. The headband 10 is, non-restrictively, made of synthetic resin material such as polypropylene (PP), beaded polypropylene (BPP), and the like. A circling movement region 11 is arranged at both ends of the headband 10 so as to correspond to the circling movement range of the slider 20, and a connecting region 12 connecting the circling movement regions 11 at both ends of the headband 10 is arranged at the central part of the headband 10. The circling movement region 11 is provided with the slide groove 30 having a predetermined length along the longitudinal direction of the headband 10.

Figure 4:
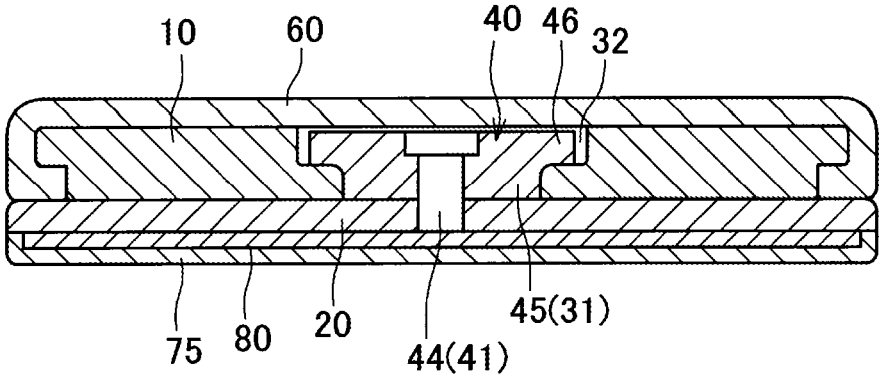
FIG. 4 is a lateral cross-sectional view showing the adjust mechanism of the headphone.

As shown in FIG. 4, the slide groove 30 includes a through-groove portion 31 passing through the headband 10 (in FIG. 4, through portion 45 of the slider guide 40 is passed through), and a flange groove portion 32 arranged on both sides of the through-groove portion 31. The flange groove portion 32 is formed as a recess arranged along both sides of the through-groove portion 31 at the outer peripheral surface of the circling movement region 11, and forms the slide groove 30 having a stair-like lateral cross-sectional structure with the through-groove portion 31. A corrugated surface 33 (undulate surface) is continuously formed on both sides of the flange groove portion 32 in correspondence to the circling movement range of the slider 20 (see FIG. 5). The corrugated surface 33 may be formed on only one side of the flange groove portion 32 instead of being formed on both sides of the flange groove portion 32.

The slider 20 is formed as a band-shaped body of circular arc shape or elliptical arc shape having a predetermined curvature, and has substantially the same cross-sectional shape (excluding the portion of the slide groove 30) as the headband 10 (in between the slider assembly). The slider 20 is, non-restrictively, made of synthetic resin material such as ABS. A female screw 21 for screw fixing the slider guide 40 with a male screw 44, and a female screw 22 for screw fixing the slider cover 75 are arranged at the upper end of the slider 20. An attachment hole 23 for attaching the headphone unit 50 and a female screw 24 for screw fixing the slider cover 75 are arranged at the lower end of the slider 20.

The headphone unit 50 includes the housing 51 incorporating the headphone driver (not shown), and the ear pad 52 to be attached to the auricle of the wearer. The headphone unit 50 is attached to the slider 20 by way of the attachment holes 23, 77 of the slider 20 and the slider cover 75 by an attachment plug 53.

The slider guide 40 has rigidity higher than the headband 10 and the slider 20, and is formed as a holding member for holding the slider 20 at the end of the headband 10. The slider guide 40 is, non-restrictively, made of synthetic resin material such as polyacedal. The slider guide 40 is formed as a substantially rectangular member that is shorter than the slide groove 30 and that has substantially the same width as the slide groove 30, and has a lateral cross-sectional structure including a through-portion 45 and a flange portion 46, as shown in FIG. 4.

The through-portion 45 is arranged with a female screw 41 (in FIG. 4, a male screw 44 is passed through) for screw fixing the slider guide 40 to the outer peripheral surface of the slider 20 with the male screw 44. The through-portion 45 is arranged to pass through the through-groove portion 31 with the bottom surface fixed to the outer peripheral surface of the slider 20 and the side surface contacted to the side surface of the through-groove portion 31. The flange portion 46 is arranged such that the bottom surface contacts the bottom surface of the flange groove portion 32.

The slider guide 40 is arranged with an elastic strip 42 on both sides of the flange portion 46, where a biasing force acts on the elastic strip 42 in the direction of both sides of the flange portion 46. The elastic strip 42 is formed by forming an L-shaped cut along the length direction of the flange portion 46 from the side surface of the flange portion 46. An engagement projection 43 is arranged at the distal end of the elastic strip 42 to engage the corrugated surface 33, which is arranged in the flange groove portion 32, by the biasing force of the elastic strip 42. The elastic strip 42 may be formed by a spring mechanism arranged at the flange portion 46, for example, instead of being formed by the cut made in the flange portion 46. An engagement recess may be arranged at the distal end of the elastic strip 42 instead of the engagement projection 43.

The headband cover 60 is formed as a covering member of circular arc shape or elliptical arc shape corresponding to the circling movement region 11 of the headband 10. A space for passing the circling movement region 11 of the headband 10 is formed in the headband cover 60 by folding both side surfaces in the longitudinal direction to the inner peripheral side. The headband cover 60 covers the circling movement region 11 of the headband 10 by passing the circling movement region 11 of the headband 10 through the pass-through space. The headband cover 60 is configured as a single part to facilitate the arrangement of the slide groove 30 and the like on the headband 10, but may be configured as part of the headband 10 by adopting the headband 10 of inward collapsing structure.

The cushion cover 65 is formed as a tubular covering material corresponding to the connecting region 12 of the headband 10. The cushion cover 65 is attached to the headband 10 so as to cover the cushion 70 formed as a band-shaped impact buffering material and the connecting region 12 of the headband 10.

The slider cover 75 is formed as a band-shaped covering member corresponding to the slider 20. A female screw 76 for screw fixing the slider cover 75 and the slider sheet 80 to the slider 20 is arranged at the upper end of the slider cover 75, and an attachment hole 77 for attaching the headphone unit 50 with respect to the slider 20 and the slider cover 75 and a female screw 78 for screw fixing the slider cover 75 to the slider 20 are arranged at the lower end of the slider cover 75. An accommodation space 79 for accommodating the slider sheet 80 is formed on the outer peripheral side of the slider cover 75.

The spacer 85 is formed as a wedge-shaped member for ensuring a predetermined gap between the inner peripheral surface of the headband 10 and the outer peripheral surface of the slider 20. The spacer 85 may be configured as part of the slider guide 40 or the slider 20 instead of being configured as a single part.

The headphone is assembled in the following procedure. First, the slider 20 and the slider cover 75 are screw coupled while accommodating the slider sheet 80 to assemble the slider assembly, and the headphone unit 50 is attached to the slider assembly by way of the attachment holes 23, 77 by the attachment plug 53. The connecting region 12 and the cushion 70 are passed through the cushion cover 65 with the cushion 70 arranged on the inner peripheral surface of the connecting region 12 of the headband 10.

The outer peripheral surface of the slider assembly is then overlapped on the inner peripheral surface of the headband 10 with the spacer 85 interposed, and the slider guide 40 and the slider assembly are screw coupled with the slider guide 40 engaged to the slide groove 30. The slider guide 40 and the slider assembly may be coupled by an adhering measures, fastening measures, and the like instead of screw coupling. Here, the slider guide 40 is engaged to the slide groove 30 such that the bottom surface of the through-portion 45 is fixed to the outer peripheral surface of the slider 20, the side surface of the through-portion 45 is contacted to the side surface of the through-groove portion 31, and the bottom surface of the flange portion 46 is contacted to the bottom surface (groove surface) of the flange groove portion 32. The slider guide 40 is also engaged to the slide groove 30 such that the engagement projection 43 of the elastic strip 42 engages the corrugated surface 33 of the flange groove portion 32. The circling movement region 11 of the headband 10 is then passed through the headband cover 60 with the slider assembly assembled with respect to the headband 10.

[Operation of the Headphone]

Figure 5A:
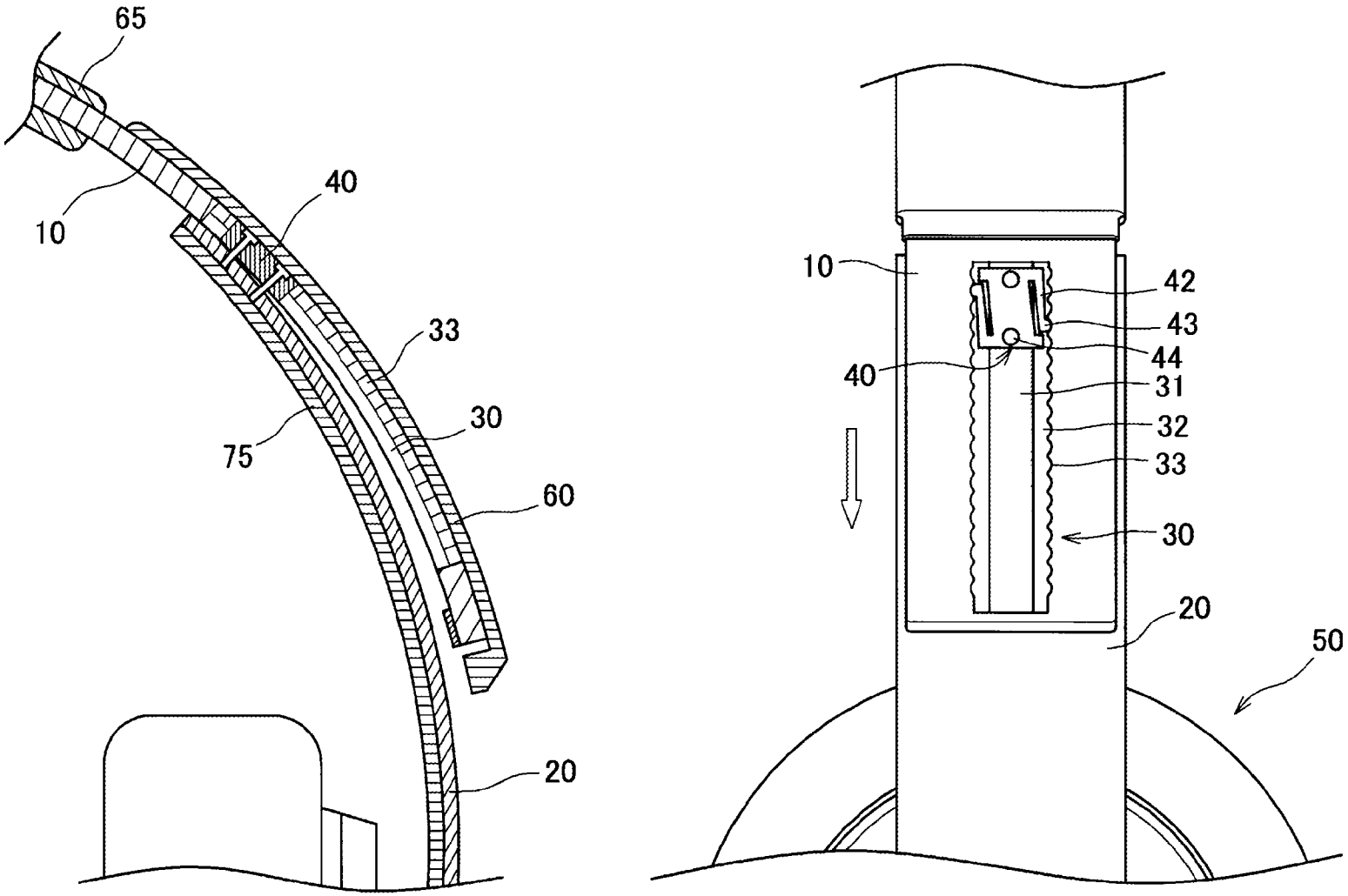
FIG. 5A is a longitudinal cross-sectional view and a side view showing the headphone in a state before the circling movement.
Figure 5B:
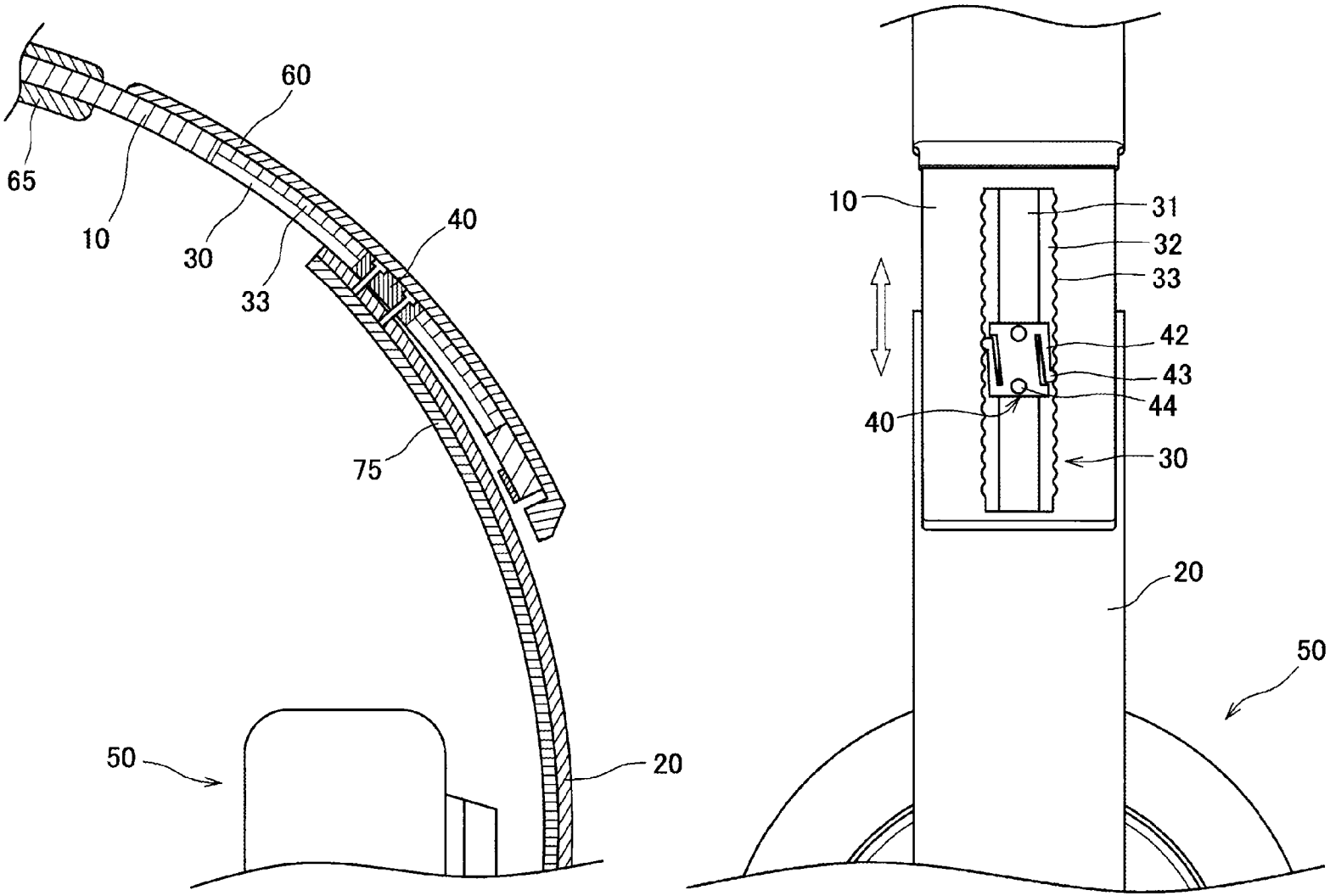
FIG. 5B is a longitudinal cross-sectional view and a side view showing the headphone in a state after the circling movement.

In the following description, the operation of the headphone will be described with reference to FIG. 5. FIG. 5A is a longitudinal cross-sectional view and a side view showing the headphone in a state before the circling movement, and FIG. 5B is a longitudinal cross-sectional view and a side view showing the headphone in a state after the circling movement. FIGS. 5A and 5B show only the left side portion of the headphone.

As shown in FIG. 5A, the size of the headphone is adjusted to be a minimum in a state before the circling movement. The slider guide 40 is engaged to the upper end of the slide groove 30, and the engagement projection 43 of the elastic strip 42 is engaged to the corrugated surface 33 at the upper end of the flange groove portion 32. The slider 20 is prevented from falling off from the headband 10 by the contacting of the bottom surface of the flange portion 46 to the bottom surface of the flange groove portion 32, and is held with respect to the headband 10 with the size of the headphone adjusted by the engagement of the engagement projection 43 of the elastic strip 42 and the corrugated surface 33 of the flange groove portion 32.

In this state, the circling movement of the slider 20 in the direction of reducing the size of the headphone is regulated when the slider guide 40 contacts the upper end of the slide groove 30. Similarly in the state in which the size of the headphone is adjusted to a maximum, the circling movement of the slider 20 in the direction of enlarging the size of the headphone is regulated when the slider guide 40 contacts the lower end of the slide groove 30.

As shown in FIG. 5B, the size of the headphone is adjusted to become greater in the state after the circling movement than in the state before the circling movement. The slider guide 40 is engaged to the intermediate part of the slide groove 30, and the engagement projection 43 of the elastic strip 42 is engaged to the corrugated surface 33 at the intermediate part of the flange groove portion 32.

When the slider 20 is circling moved, the slider guide 40 moves with respect to the slide groove 30 thereby adjusting the size of the headphone. The slider guide 40 moves with respect to the slide groove 30 while having the movement guided by the slide groove 30 when the side surface of the through-portion 45 contacts the side surface of the through-groove portion 31 and the bottom surface of the flange portion 46 contacts the bottom surface of the flange groove portion 32.

The slider guide 40 moves along the slide groove 30 by the biasing force of the elastic strip 42 while the engagement projection 43 of the elastic strip 42 repeats engagement and disengagement with the corrugated surface 33 of the flange groove portion 32. The engagement resistance is thus generated between the engagement projection 43 and the corrugated surface 33 (e.g., when the engagement projection 43 engages the valley portion of the corrugated surface 33), and the movement of the slider guide 40 is regulated by the engagement resistance thereby realizing the adjust mechanism capable of adjusting the size of the headphone in a step-wise manner according to the shape of the corrugated surface 33.

Instead of arranging the adjust mechanism capable of making step-wise adjustment, an adjust mechanism capable of making non-step wise adjustment may be arranged. In this case, for example, the corrugated surface 33 of the flange groove portion 32 and the engagement projection 43 of the elastic strip 42 can be omitted, the friction resistance is generated between the side surface of the elastic strip 42 and the side surface of the flange groove portion 32 by the biasing force of the elastic strip 42, and the movement of the slider guide 40 is regulated by the friction resistance thereby realizing the adjust mechanism capable of making non-step wise adjustment. The elastic strip 42 may be formed by a spring mechanism arranged at the slider guide 40, or a stopper mechanism arranged between the slider guide 40 and the slide groove 30 instead of being formed by the cut made in the flange portion 46.

In the headphone, one end of the slider 20 is held at the end of the headband 10 such that the outer peripheral surface of the slider 20 facing the inner peripheral surface of the headband 10 can circling move with respect to the inner peripheral surface of the headband 10 by the slider guide 40 engaged to the slide groove 30, and thus the difference in cross-sectional shapes is less likely to be created between the headband 10 and the slider 20 (slider assembly). Therefore, the difference in rigidity is less likely to be created by having the headband 10 and the slider 20 (slider assembly) to substantially the same cross-sectional shape, whereby deflection can be uniformly produced at the entire headband 10 and the slider 20. The wearer thus can use the headphone in a state evenly deflected so as to follow the size of the head, and lowering of the attachment property of the headphone can be suppressed.

The difference in rigidity may be adjusted by changing the material and the like without having the headband 10 and the slider 20 (slider assembly) to substantially the same cross-sectional shape, but this arises another issue in that the member of small cross-sectional shape becomes relatively weak and breakage of the member tends to easily occur. By way of reference, the difference in cross-sectional shapes leads to difference in rigidity of the third power of the member thickness and proportional to the member width in the case of a rectangular member.

Furthermore, since one end of the slider 20 is held at the end of the headband 10 by the slider guide 40 having a rigidity higher than the headband 10 and the slider 20 by way of the inner peripheral surface of the headband 10 and the outer peripheral surface of the slider 20, the inner hollow cross-section for inserting or passing through the slider 20 may not be ensured, and the rigidity particularly at the connecting portion is easily ensured by the slider guide 40. The member thickness of the headband 10 thus can be suppressed and the thinning of the headphone can be facilitated.

Figure 8:
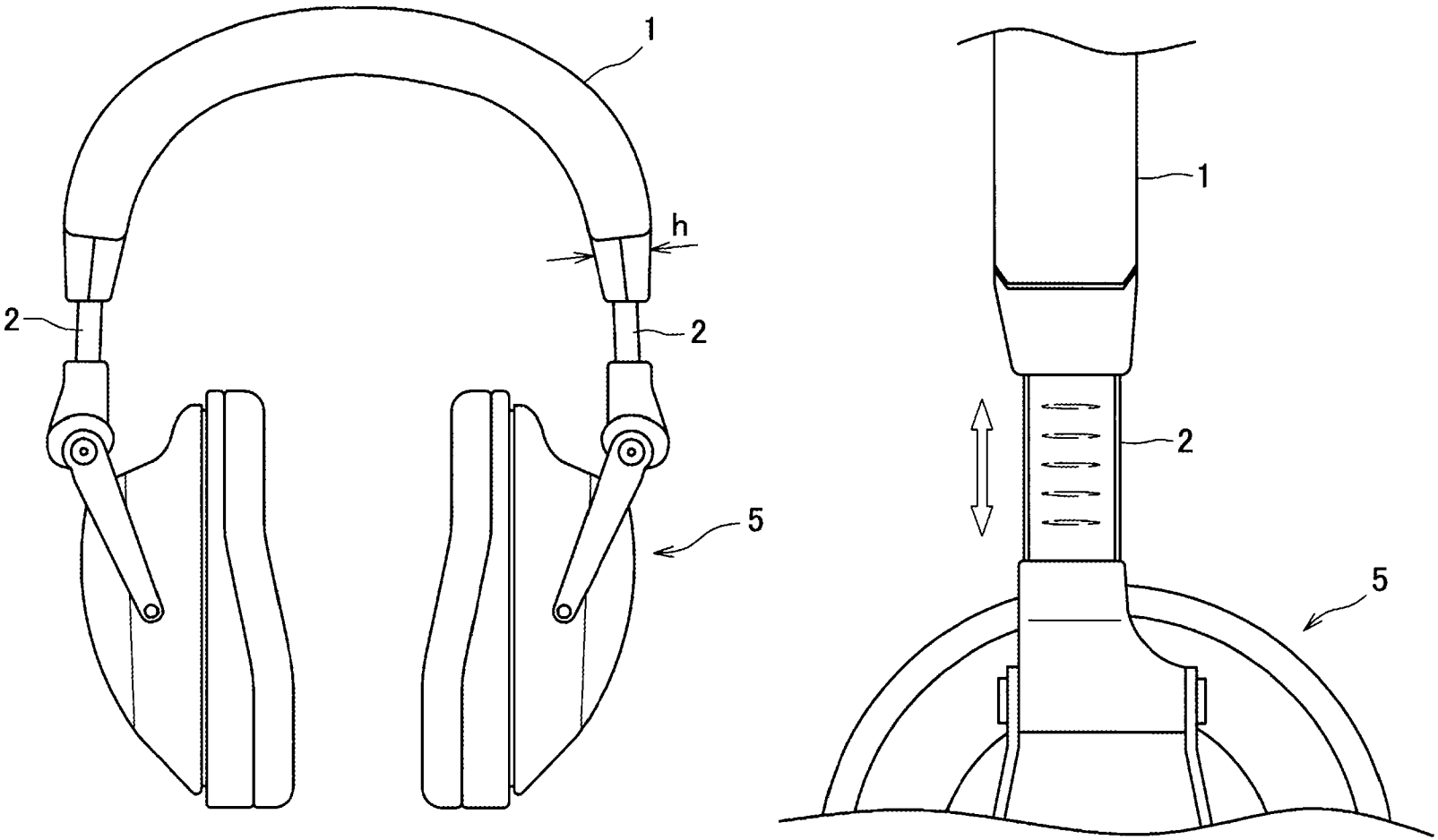
FIG. 8 is a view showing a headphone of a related art including an inserting type slider.
Figure 9:
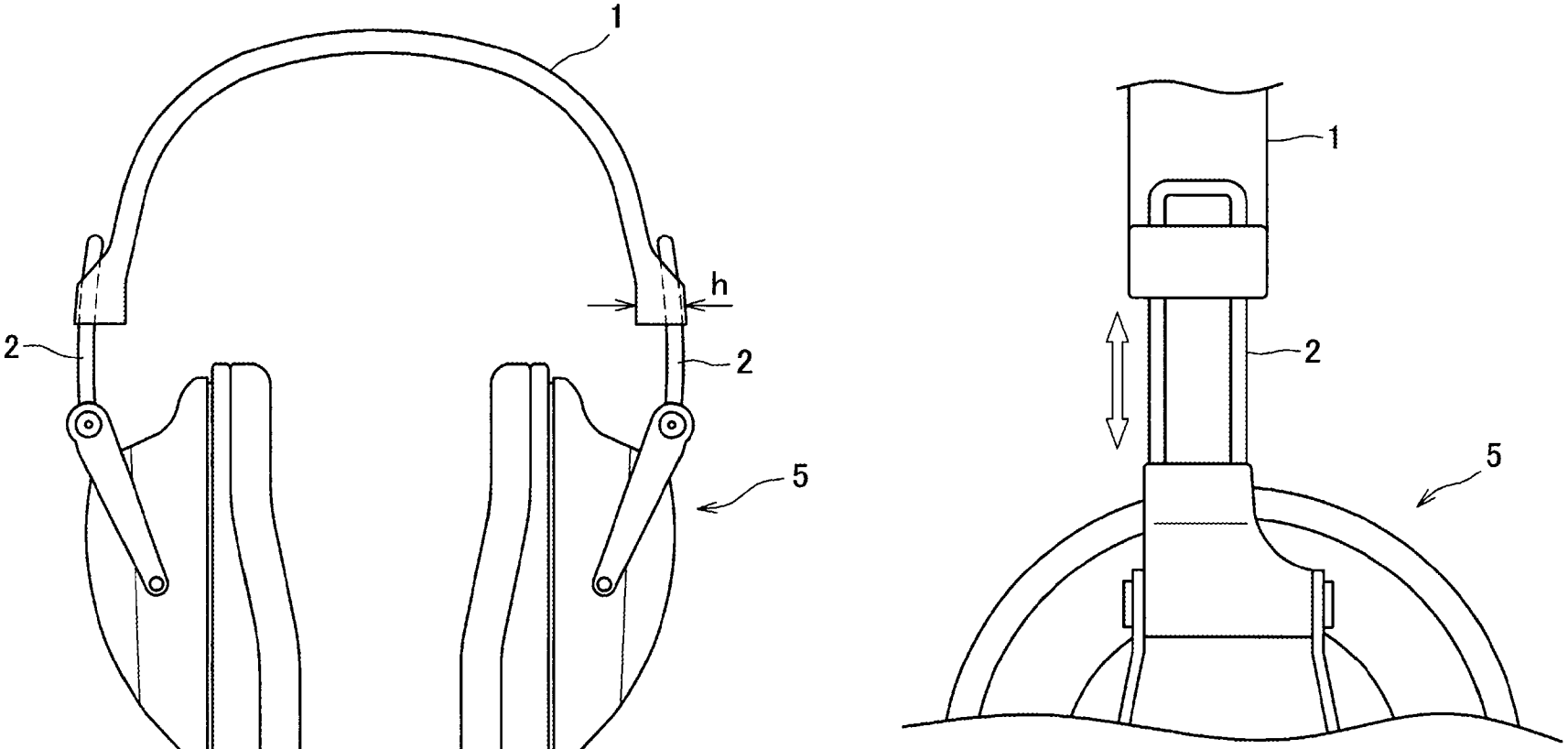
FIG. 9 is a view showing a headphone of a related art including a pass-through type slider.

Furthermore, in the headband 10 of the related art shown in FIGS. 8 and 9, the continuity (unity) in design of the headband 10 and the slider 20 is destroyed and the aesthetic property of the headphone lowers when the slider 20 having a cross-sectional shape different from the headband 10 is exposed in time of the circling movement. In the headband 10 according to the present embodiment, on the contrary, the headband 10 and the slider 20 (slider assembly) are formed to substantially the same cross-sectional shape, so that the continuity in design of the headband 10 and the slider 20 is not destroyed and the lowering of the aesthetic property of the headphone can be suppressed even if the slider 20 is exposed in time of the circling movement.

Furthermore, in the headband 10 of the related art as shown in FIGS. 8 and 9, the deflection of the slider 20 becomes large compared to the headband 10, and the slider 20 at both ends deflects to the "chevron" shape with respect to the headband 10 when a large difference in rigidity is created from the difference in the cross-sectional shapes, whereby the aesthetic property of the headphone lowers. In the headband 10 according to the present embodiment, the headband 10 and the slider 20 (slider assembly) have substantially the same cross-sectional shape, and thus the difference in rigidity is less likely to be created, the deflection can be evenly produced at the entire headband 10 and the slider 20, and lowering of the aesthetic property of the headphone can be suppressed.

[Scratch Resistant Mechanism]

Since the slider 20 is circling moved with respect to the headband 10 in the headphone including the adjust mechanism, scratches tend to be easily formed at the headband 10 and the slider 20. In particular, when the slider 20 is circling moved with the lateral pressure acting on the slider 20, a large friction resistance is generated at the contacting surfaces of the headband 10 and the slider 20, and scratches tend to easily be formed. This may lower the aesthetic property of the headphone.

Figure 6:
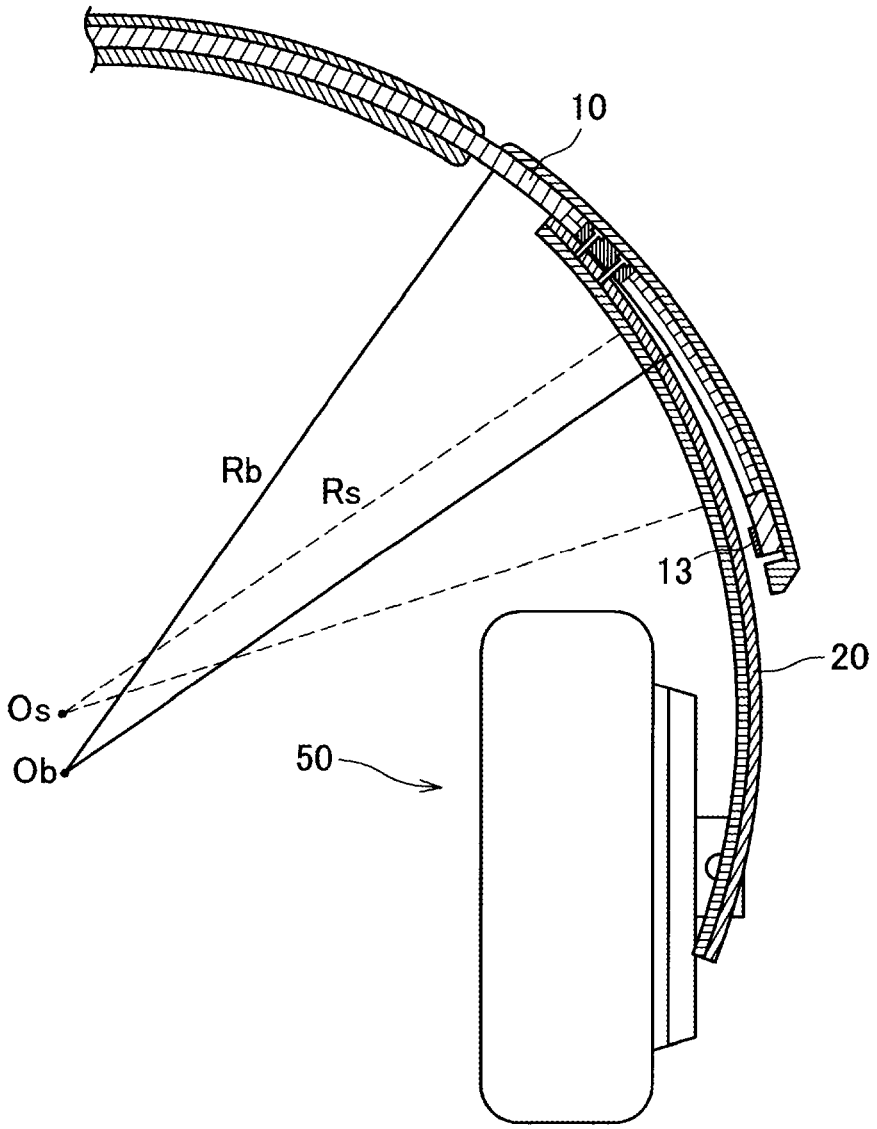
FIG. 6 is a longitudinal cross-sectional view showing an attachment state of the headband and the slider.

Therefore, in the headphone according to the present embodiment, a scratch resistance mechanism as shown in FIG. 6 is arranged such that the curvature radius Rs and the center of curvature Os of the slider 20, and the like are adjusted by adopting a configuration specific to the adjust mechanism including the headband 10, the slider 20, and the slider guide 40. FIG. 6 is a longitudinal cross-sectional view showing an attachment state of the headband 10 and the slider 20. In the configuration of the adjust mechanism of the related art, the headband 1 and the slider 2 are attached to each other in the inserted or the passed-through state, and thus the circling movement property of the slider 2 may not be appropriately ensured if the curvature radius Rs and the center of curvature Os of the slider 2 are adjusted.

The headphone is configured such that the curvature radius Rs of the slider 20 becomes smaller than the curvature radius Rb of the headband 10. The headband is configured such that the center of curvature Os of the slider 20 is positioned on the upper side than the center of curvature Ob of the headband 10 (direction of approaching the connecting region 12 of the headband) by the gap ensured by the spacer 85 (see FIG. 3). A scratch resistant sheet 13 is arranged in a projecting manner at the distal end portion of the inner peripheral surface of the headband 10.

A large gap is ensured between the headband 10 and the slider 20 towards the distal end side of the headband 10 by adjusting the curvature radius Rs and the center of curvature Os of the slider 20, as described above. Therefore, even when the slider 20 is circling moved with respect to the headband 10 (particularly when the lateral pressure is acting etc.), scratches are less likely to be formed at the headband 10 and the slider 20 by the slidable movement friction of the headband 10 and the slider 20, and the lowering of the aesthetic property of the headphone can be suppressed. Furthermore, even when the slider 20 is circling moved with an excessively large lateral pressure acting on the slider 20, a gap is maintained between the headband 10 and the slider 20 by the scratch resistant sheet 13, and thus scratches can be prevented from being formed.

[Catch Preventing Mechanism]

In the headphone including the adjust mechanism, the hair of the wearer tends to be caught between the headband 10 and the slider 20 when the slider 20 is circling moved with respect to the headband 10, which may lower the attachment property of the headphone. Thus, the headphone according to the present embodiment is arranged with the catch preventing mechanism (catch preventing sheet) to prevent the hair from being caught.

As shown in FIG. 3, the catch preventing sheet is arranged at the upper end (sheet 25) of the outer peripheral surface of the slider 20 and the side surface part (sheet 61) of the headband cover 60. The catch preventing sheets 25, 61 are arranged at the upper end and the side surface part of the outer peripheral surface of the slider 20 so as to cover the gap between the inner peripheral surface of the headband 10 and the outer peripheral surface of the slider 20, thereby preventing foreign substances from entering from the gap. The hair is thus less likely to be caught, and the lowering of the attachment property of the headphone can be suppressed.

[Cord Accommodation Mechanism]

In a headphone in which an audio output cord 90 is pulled out from the left and right headphone units 50, the presence of the audio output cord 90 tends to be felt cumbersome such as when the cord 90 touches the body of the wearer, which may lower the attachment property of the headphone. Thus, the headphone according to the present embodiment is configured to accommodate an extension cord 91 for connecting the left and right headphone units 50 in the headband 10 and the slider 20 to pull out the audio output cord 90 from one headphone unit 50 (headphone unit 50 on the right side in the present embodiment).

Figure 7:
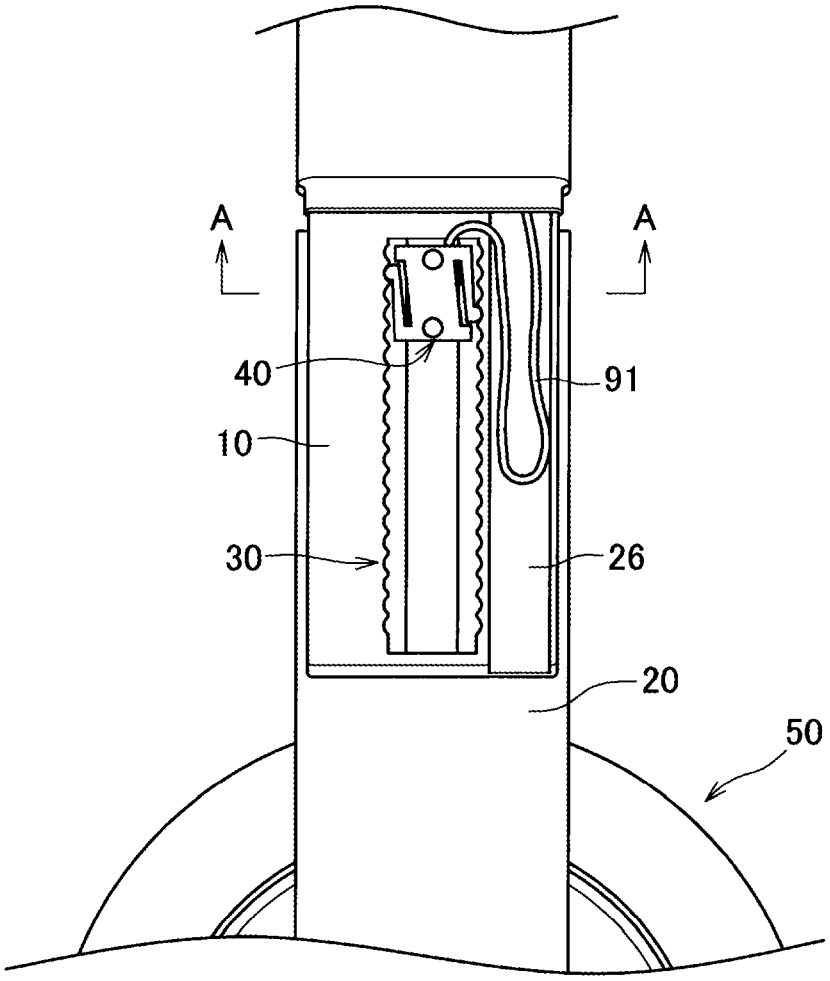
FIG. 7 is a side view and a lateral cross-sectional view showing an accommodation mechanism of an extension cord.
Figure 7:
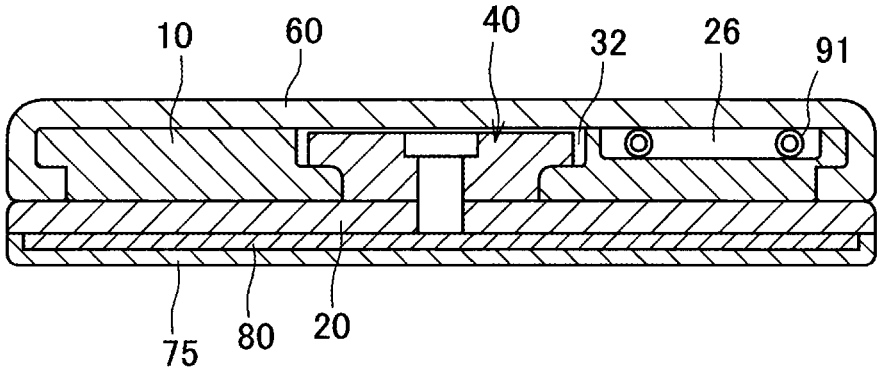

The extension cord 91 is wired to connect the headphone driver incorporated in the left and right headphone units 50 by way of the headband 10 and the slider 20. The extension of the extension cord 91 is determined in correspondence to the state in which the size of the headphone is adjusted to a maximum by the circling movement of the slider 20, and thus it is in a loose state if the size of the headphone is not adjusted to a maximum. Thus, as shown in FIG. 7, an accommodation space 26 for accommodating the extension cord 91 in a loose state is provided at the outer peripheral surface of the headband 10. FIG. 7 is a side view and a lateral cross-sectional view (cross-section A) showing an accommodation mechanism of the extension cord 91.

The extension cord 91 is passed to the interior of the slider assembly from one headphone driver, pulled out to the accommodation space 26 through the slide groove 30 from the upper end of the slider assembly, passed between the headband 10 and the headband cover 60, and connected to the other headphone driver through the other slider assembly. The audio output cord 90 thus can be easily pulled out from one headphone unit 50, the presence of the audio output cord 90 will not be felt cumbersome, and the lowering of the attachment property of the headphone can be suppressed.

[Ear Pad]

As described above, the headphone unit 50 includes the housing 51 and the ear pad 52, and is attached to the slider 20 by way of the housing 51. As shown in FIG. 3, the housing 51 is connected in a freely turning manner with respect to the end of the headband 10, and the ear pad 52 has a thickness of greater than or equal to at least twice the housing 51. Thus, even if the housing 51 is connected with respect to the end of the headband 10 by way of a thin-plate member having a high rigidity such as the slider 20, stable wearing feeling can be realized by the cushion effect of the ear pad 52.

The ear pad 52 is formed to a size of covering the auricle of the wearer, has the cushion material attached at the interior, and is configured to be able to contract according to the lateral pressure from the headband 10. A satisfactory audition environment thus can be realized by shutting out the noise from the outside of the headphone unit 50 since the headphone unit 50 is attached with the ear pad 52 closely attached to the periphery of the auricle of the wearer.

The housing 51 is connected to the end of the headband 10 in a freely turning manner by a uniaxial turning mechanism. The turning mechanism includes a shaft part arranged in a projecting manner from the attachment hole 77 of the slider cover 75, and a bearing part arranged at the central projecting portion of the housing 51. The tilt of the contacting surface of the ear pad 52 with respect to the auricle of the wearer can be adjusted by turning the housing 51 with respect to the shaft part of the turning mechanism. The ear pad 52 is configured with the cushion material filled in the interior thereof so that the tilt of the housing 51 with respect to the shaft part of the turning mechanism can be absorbed. Therefore, even if the housing 51 tilts in a direction that is not desired by the wearer, the tilt of the housing 51 is absorbed by the cushion effect of the ear pad 52 and a stable wearing feeling can be maintained.

Although a preferred embodiment of the present invention is described in the foregoing with reference to the drawings, the present invention is not limited thereto. It should be understood by those skilled in the art that various modifications, combinations, sub-combinations and alterations may occur depending on design requirements and other factors insofar as they are within the scope of the appended claims or the equivalents thereof.

The headphone according to the present embodiment is configured such that the outer peripheral surface of the slider 20 can circling move with respect to the inner peripheral surface of the headband 10, but may be configured such that the inner peripheral surface of the slider can circling move with respect to the outer peripheral surface of the headband. Furthermore, the slide groove 30 is arranged at the headband 10 and the slider guide 40 is fixed to the slider 20 by way of the slide groove 30 in the headphone according to the present embodiment, but the slide groove may be arranged at the slider and the slider guide may be fixed to the headband by way of the slide groove.

The present invention contains subject matter related to Japanese priority Patent Application JP 2008-212151 filed in the Japan Patent Office on Aug. 20, 2008, the entire contents of which being incorporated herein by reference.

What is claimed is:

1. A headphone comprising: a headband having flexibility; a slider having flexibility with the headband attached at one end, and a headphone unit attached at the other end; a slide groove, arranged at an end of the headband or the one end of the slider, for guiding a circling movement of the slider with respect to the headband; and a slider guide, having rigidity higher than the headband and the slider, for holding the one end of the slider at a first end of the headband so that one surface of the slider facing one surface of the headband moves circularly with respect to the one surface of the headband while the slider guide is engaged to the slide groove, wherein the slider guide is movable with respect to the headband, wherein the slider guide is attached to the slider, the slider guide and slide groove being hidden from view when the headphone is viewed from the side, wherein the headband has a first side facing inwardly toward a wearer's head when the headphone is worn, a second side facing outwardly away from the wearer's head, the slider being located at one of the first or second sides of the headband, and wherein the slide groove and the slider guide cooperate to form a detent mechanism such that movement of the slider relative to the headband occurs in a step-wise manner.

2. The headphone according to claim 1, wherein the slide groove is formed with an engaged surface corresponding to the circling movement range of the slider; the slider guide is arranged with an engagement portion for engaging the engaged surface by a biasing force; and the slider guide relatively moves with respect to the slide groove according to the circling movement of the slider, and regulates the circling movement of the slider by an engagement resistance with the slide groove with the engagement portion engaged with the engaged surface.

3. The headphone according to claim 1, wherein the slider guide regulates the circling movement of the slider by a friction resistance with the slide groove while being engaged to the slide groove.

4. The headphone according to claim 1, wherein the slider guide holds the one end of the slider at the first end of the headband so that an outer peripheral surface of the slider facing an inner peripheral surface of the headband moves circularly with respect to the inner peripheral surface of the headband.

5. The headphone according to claim 1, wherein the headband and the slider have substantially the same cross-sectional shape.

6. The headphone according to claim 1, further comprising:

a housing, connected in a freely turning manner to an end of the headband by a uniaxial turning mechanism, for emitting sound; and an ear pad attached on a side of the housing that is opposite to the side connected with the headband, wherein the ear pad has a thickness of greater than or equal to twice the housing.

7. The headphone according to claim 6, wherein the ear pad is formed to a size of covering an auricle of a wearer and with a cushion material filled in an interior, and is configured to contract according to a lateral pressure from the headband.

8. The headphone according to claim 6, wherein the ear pad is configured to absorb tilt of the housing with respect to an axial direction of the turning mechanism.

9. The headphone according to claim 1, wherein a radius of curvature of the slider is less than a radius of curvature of the headband.

10. The headphone according to claim 9, wherein a center of curvature of the slider is offset from a center of curvature of the headband.

11. The headphone according to claim 9, further comprising a spacer between the headband and the slider.

12. The headphone according to claim 9, further comprising a scratch-resistant sheet coupled to the one surface of the headband.

13. The headphone according to claim 9, wherein at least one sheet is arranged to cover a gap between the one surface of the slider and the one surface of the headband.

14. The headphone according to claim 1, wherein the slide groove includes a corrugated surface.

15. The headphone according to claim 1, further comprising an engagement projection coupled to the slider guide and biased outwardly from the slider guide toward the slide groove.

16. The headphone according to claim 1, wherein the slide groove has a stair-like cross-section.

* * * * *